US007437835B2

(12) United States Patent
Marvin et al.

(10) Patent No.: US 7,437,835 B2
(45) Date of Patent: Oct. 21, 2008

(54) CUSHIONING SOLE FOR AN ARTICLE OF FOOTWEAR

(75) Inventors: William Marvin, Canton, MA (US); Brian Christensen, Canton, MA (US); Paul Litchfield, Canton, MA (US); William McInnis, Canton, MA (US)

(73) Assignee: Reebok International, Ltd., Canton, MA (US)

( * ) Notice: Subject to any disclaimer, the term of this patent is extended or adjusted under 35 U.S.C. 154(b) by 0 days.

(21) Appl. No.: 11/491,168

(22) Filed: Jul. 24, 2006

(65) Prior Publication Data

US 2007/0033832 A1 Feb. 15, 2007

Related U.S. Application Data

(63) Continuation of application No. 10/607,541, filed on Jun. 27, 2003, now Pat. No. 7,080,467.

(51) Int. Cl.
*A43B 13/20* (2006.01)

(52) U.S. Cl. ..... 36/29; 36/28; 36/35 B

(58) Field of Classification Search ..... 36/29, 36/35 B, 153

See application file for complete search history.

(56) References Cited

U.S. PATENT DOCUMENTS

| | | | | |
|---|---|---|---|---|
| 3,180,039 | A | 4/1965 | Burns, Jr. | |
| 4,521,979 | A * | 6/1985 | Blaser | 36/29 |
| 4,768,295 | A | 9/1988 | Ito | |
| 4,887,367 | A | 12/1989 | Mackness et al. | |
| 5,235,715 | A | 8/1993 | Donzis | |
| 5,425,184 | A | 6/1995 | Lyden et al. | |
| 5,607,749 | A | 3/1997 | Strumor | |
| 5,655,315 | A | 8/1997 | Mershon | |
| 5,704,137 | A | 1/1998 | Dean et al. | |
| 5,901,467 | A | 5/1999 | Peterson et al. | |
| 5,930,918 | A | 8/1999 | Healy et al. | |
| 6,428,865 | B1 * | 8/2002 | Huang | 36/29 |
| 6,436,612 | B1 * | 8/2002 | Chang | 36/29 |
| 6,457,263 | B1 * | 10/2002 | Rudy | 36/29 |
| 6,519,873 | B1 | 2/2003 | Buttigieg | |
| 6,689,314 | B2 | 2/2004 | Bushman et al. | |

(Continued)

FOREIGN PATENT DOCUMENTS

| | | |
|---|---|---|
| WO | WO 93/14659 A1 | 8/1993 |

(Continued)

*Primary Examiner*—Ted Kavanaugh
(74) *Attorney, Agent, or Firm*—Sterne, Kessler, Goldstein & Fox, PLLC

(57) ABSTRACT

A hollow sole is formed within the sole of a shoe wherein a top component having a flat portion and an outer wall is adhered to a bottom component wherein the depth of the outer wall defines an enclosed space between the top and bottom components. The outer wall of the top component and the walls of the bottom component that rise to and fall from the weld lines are made with flexible ridges which provides a bellowing effect when the pressure of the foot is pushed down on the sole. In one embodiment, a fluidly connected inside compartment and outside compartment are created by welded lines adhering the bottom component to the top component. In an alternate embodiment, the hollow sole may contain foam for extra support. Fluid pockets and other flow structures are bored into the foam to allow for the dynamic fluid flow.

20 Claims, 20 Drawing Sheets

U.S. PATENT DOCUMENTS

| | | | |
|---|---|---|---|
| 6,745,499 | B2 | 6/2004 | Christensen et al. |
| 6,845,573 | B2 | 1/2005 | Litchfield et al. |
| 6,892,477 | B2 | 5/2005 | Potter et al. |
| 7,080,467 | B2 | 7/2006 | Marvin et al. |
| 2002/0121031 | A1 | 9/2002 | Smith et al. |
| 2005/0016021 | A1 | 1/2005 | Marvin et al. |

FOREIGN PATENT DOCUMENTS

| | | |
|---|---|---|
| WO | WO 95/20332 | 8/1995 |
| WO | WO 98/09546 | 3/1998 |

* cited by examiner

CUSHIONING SOLE FOR AN ARTICLE OF FOOTWEAR

This application is a continuation of U.S. application Ser. No. 10/607,541, filed on Jun. 27, 2003 now U.S. Pat. No. 7.080,467.

BACKGROUND OF THE INVENTION

1. Field of the Invention

The field of this invention generally relates to footwear, and more particularly to an article of footwear providing dynamic cushioning and support for the comfort of the wearer due to the flow of a fluid disposed in the sole.

2. Background of the Invention

One of the problems associated with footwear, especially athletic shoes, has always been striking a balance between support and cushioning. Throughout the course of an average day, the feet and legs of an individual are subjected to substantial impact forces. Running, jumping, walking, and even standing exert forces upon the feet and legs of an individual which can lead to soreness, fatigue, and injury.

The human foot is a complex and remarkable piece of machinery, capable of withstanding and dissipating many impact forces. The natural padding of fat at the heel and forefoot, as well as the flexibility of the arch, help to cushion the foot. An athlete's stride is partly the result of energy which is stored in the flexible tissues of the foot. For example, a typical gait cycle for running or walking begins with a "heel strike" and ends with a "toe-off". During the gait cycle, the main distribution of forces on the foot begins adjacent to the lateral side of the heel (outside of the foot) during the "heel strike" phase of the gait, then moves toward the center axis of the foot in the arch area, and then moves to the medial side of the forefoot area (inside of the foot) during "toe-off". During a typical walking or running stride, the achilles tendon and the arch stretch and contract, storing and releasing energy in the tendons and ligaments. When the restrictive pressure on these elements is released, the stored energy is also released, thereby reducing the burden which must be assumed by the muscles.

Although the human foot possesses natural cushioning and rebounding characteristics, the foot alone is incapable of effectively overcoming many of the forces encountered during athletic activity. Unless an individual is wearing shoes which provide proper cushioning and support, the soreness and fatigue associated with athletic activity is more acute, and its onset accelerated. The discomfort for the wearer that results may diminish the incentive for further athletic activity. Equally important, inadequately cushioned footwear can lead to injuries such as blisters; muscle, tendon and ligament damage; and bone stress fractures. Improper footwear can also lead to other ailments, including back pain.

Proper footwear should complement the natural functionality of the foot, in part by incorporating a sole (typically including an outsole, midsole and insole) which absorbs shocks. However, the sole should also possess enough resiliency to prevent the sole from being "mushy" or "collapsing," thereby unduly draining the energy of the wearer.

In light of the above, numerous attempts have been made to incorporate into a shoe improved cushioning and resiliency. For example, attempts have been made to enhance the natural elasticity and energy return of the foot by providing shoes with soles which store energy during compression and return energy during expansion. These attempts have included the formation of shoe soles that include springs, gels or foams such as ethylene vinyl acetate (EVA) or polyurethane (PU).

However, all of these tend to either break down over time or do not provide adequate cushioning characteristics.

Another concept practiced in the footwear industry to improve cushioning and energy return has been the use of fluid-filled systems within shoes soles. These devices attempt to enhance cushioning and energy return by transferring a pressurized fluid between the heel and forefoot areas of a shoe. The basic concept of these devices is to have cushions containing pressurized fluid disposed adjacent the heel and forefoot areas of a shoe.

However, a cushioning device which is pressurized with gas at the factory is comparatively expensive to manufacture. Further, pressurized gas tends to escape from such a cushioning device, requiring large molecule gasses such as Freon to be used as the inflating fluid. A cushioning device which contains air at ambient pressure provides several benefits over similar devices containing pressurized fluid. For example, generally a cushioning device which contains air at ambient pressure will not leak and lose air, because there is no pressure gradient in the resting state.

The problem with many of these cushioning devices is that they are either too hard or too soft. A resilient member that is too hard may provide adequate support when exerting pressure on the member, such as when running. However, the resilient member will likely feel uncomfortable to the wearer when no force is exerted on the member, such as when standing. A resilient member that is too soft may feel cushy and comfortable to a wearer when no force is exerted on the member, such as when standing or during casual walking. However, the member will likely not provide the necessary support when force is exerted on the member, such as when running. Further, a resilient member that is too soft may actually drain energy from the wearer.

Another problem with these cushioning systems are manufacturing constraints. Typically, the cushioning device is made separately from the sole material of the shoe requiring extra manufacturing steps and additional raw materials.

BRIEF SUMMARY OF THE INVENTION

To achieve the foregoing and other objects, and in accordance with the purposes of the present invention as embodied and broadly described herein, there is fully described herein an article of footwear, which comprises an upper and a sole. At least a portion of the sole, in the heel region, the metatarsal region, or both regions, includes a cushioning mechanism. The mechanism includes a hollow container made of a plastic material or other similar fluid-impermeable material.

In one embodiment, the hollow container is shaped to form an inside compartment and an outside compartment which are fluidly connected. These compartments are created by a discontinuous weld line in the middle of the hollow sole, wherein a bottom component of the hollow sole is welded to a top component of the hollow sole along the discontinuous weld line. The opening in the weld line is the fluid connector between the inside and outside compartments.

In another embodiment, disposed within the container is a core made of a single piece of foam or two pieces of foams of different densities. Carved into the foam is a fluid system of pockets and conduits. A fluid, such as air or nitrogen, resides within the fluid system. When the wearer exerts pressure on the sole during the "heel strike", the cushioning mechanism compresses in the region of the heel strike, causing the fluid to flow away from the heel region. As the wearer's foot rolls through the gait cycle, the flowing fluid dynamically cushions the foot.

BRIEF DESCRIPTION OF THE DRAWINGS/FIGURES

DETAILED DESCRIPTION OF THE INVENTION

Preferred embodiments of the present invention are now described with reference to the figures. In the figures, the left most digit of each reference number corresponds to the figure in which the reference number is first used. While specific configurations and arrangements are discussed, it should be understood that this is done for illustrative purposes only. A person skilled in the relevant art will recognize that other configurations and arrangements can be used without departing from the spirit and scope of the invention.

Figure 1:
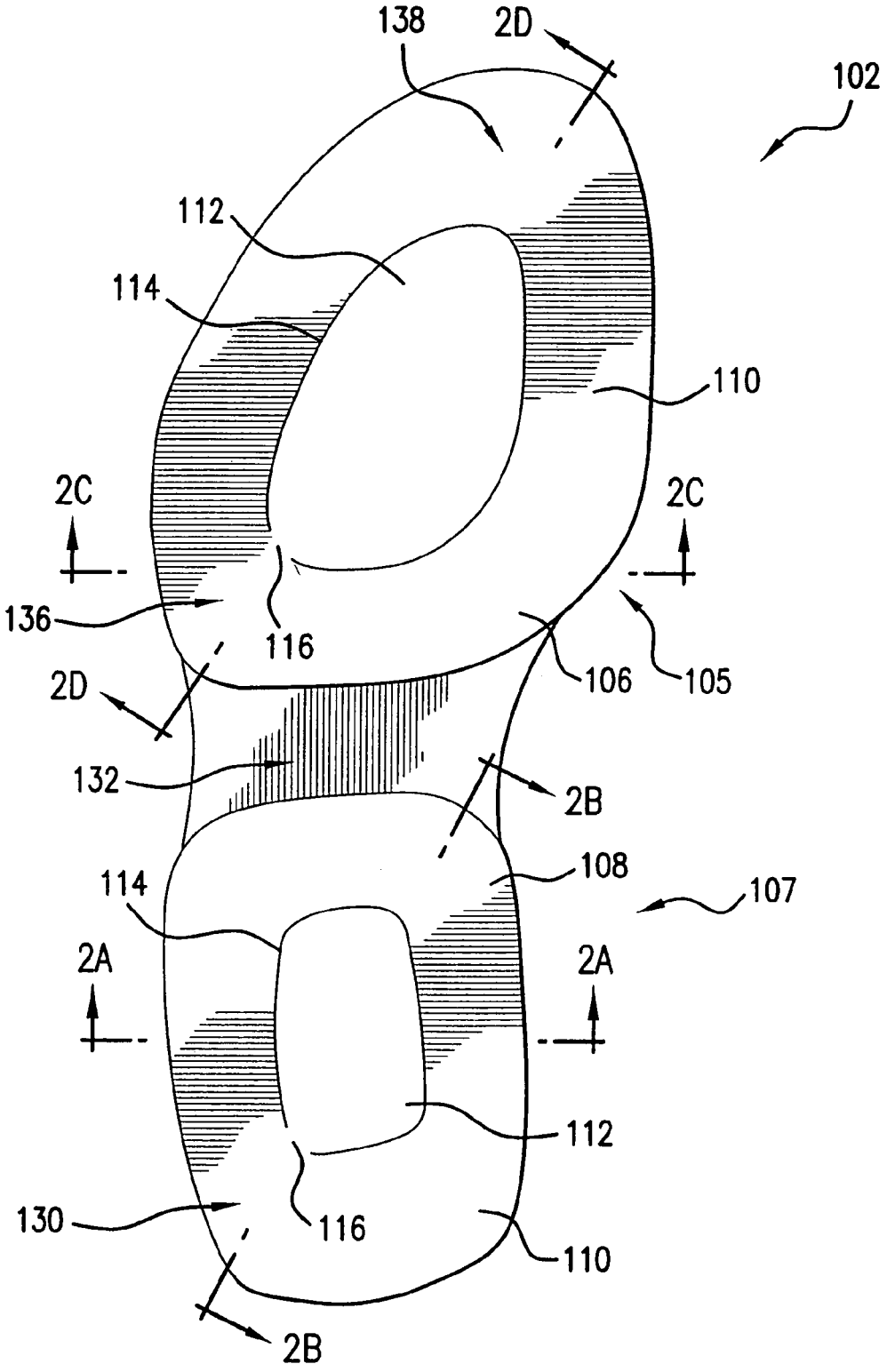
FIG. 1 is a bottom plan view of a sole of the present invention.

Referring now to FIG. 1, a sole 102 according to one embodiment of the present invention is described. Sole 102 is divided into forefoot portion 105 and heel portion 107 both having the same general features. A cushioning mechanism according to the present invention is disposed in each of forefoot portion 105 and heel portion 107. Each portion 105, 107 is a hollow container made of a plastic material or other similar fluid-impermeable material. Hollow containers 106, 108 are preferably made from injection molded TPU, although other materials and processes (i.e., vacuum forming, etc.) with similar properties may also be used. The walls of hollow containers 106, 108 are approximately 1.0 mm thick, although the actual thickness of the walls will vary greatly depending upon the type of material used and the desired flexibility and durability of hollow containers 106, 108. Hollow containers 106, 108 have an exterior compartment 110 and an interior compartment 112 divided by at least one weld line 114. In the embodiment shown in FIG. 1, weld line 114 and the contours of the surface of hollow containers 106, 108 define interior compartment 112 and exterior compartment 110. Weld line 114 is preferably discontinuous, creating a fluid connection 116 at the point of discontinuity. Fluid connection 116 between exterior compartment 110 and interior compartment 112 allows air to flow between exterior compartment 110 and interior compartment 112. The flowing air provides dynamic cushioning and support that corresponds to the natural pressures of the foot.

Although the perimeters of hollow containers 106, 108 are shown in FIG. 1 to be generally straight on the medial and lateral sides, the geometry thereof can be sculpted to accommodate different gait characteristics. For example, additional surface area can be added to medial side edge to increase the stability on that side, providing posting to control overpronation. Furthermore, curved edges are preferred, as straight edges have a tendency to bow out, creating unnecessary stresses on containers 106, 108 that could lead to early failure of the part.

The location of the opening of the discontinuous weld line determines the location of fluid connection 116. In a preferred embodiment, the opening of the discontinuous weld line in heel container 108 faces a back lateral portion 130 of sole 102. The opening of the discontinuous weld line in forefoot portion 106 faces a lateral arch 136 of sole 102. Thus, fluid connection 116 allows air to flow back and forth between exterior compartment 110 and interior compartment 112. The location, size, and number of openings in discontinuous weld line 114 as well as the amount of restriction in the opening of discontinuous weld line 114 can be varied, as would be readily apparent to one of ordinary skill in the art, to achieve a desired air flow between interior compartment 112 and exterior compartment 110. While fluid connection 116 may simply be a small hole created by discontinuous weld line 114, a restrictive uni-directional or bi-directional valve for controlling the flow of fluid may be placed in the hole created at the point of discontinuity of discontinuous weld line 114. This type of fluid connection 116 is particularly applicable to the embodiment shown in FIG. 5, with multiple fluid connections 116. For example, one or more of the fluid connections 116 would contain restrictive valves, slowing the fluid transfer in those areas while the fluid transfer rate in other fluid connections 116 would be unimpeded, thereby offering a greater degree of control over the fluid flow.

During a typical gait cycle, exterior compartment 110 of heel portion 108 first strikes the ground in back lateral portion 130 of sole 102. The air that is initially in this area cushions the heelstrike as exterior compartment 110 collapses. The air pressure in rear lateral portion 130 is quickly increased as the foot presses down; this increase in pressure causes the air to flow out of this area. Some of the air flows through fluid connection 116 into interior compartment 112. Some of the air flows around both sides of exterior compartment 110 towards an arch area 132 of the shoe.

The air that enters interior compartment 112 provides support and cushioning for the foot as the foot rolls through the gait cycle from rear lateral portion 130 toward arch area 132 of the foot. When the downward force from the foot reaches arch area 132 of the shoe, some of the initial pressure in rear lateral portion 130 of exterior compartment 110 is released as exterior compartment 110 is allowed to expand, which causes air to flow from arch area 132 back around both sides of exterior compartment 110 towards rear lateral area 130 of exterior compartment 110 and from interior compartment 112 back through fluid connector 116 and.

Similarly, pressure from the foot first impacts the forefoot area of sole 102 in arch area 132. As the foot continues to roll onto forefoot portion 106 of sole 102, the air in lateral arch area 136 of exterior compartment 110 cushions the foot in this region as exterior compartment 110 collapses. The air then flows through fluid connector 116 into interior compartment 112 and around both sides of exterior compartment 110 towards a toe area 138 of sole 102. The increase of pressure in interior compartment 112 and in toe area 138 supports the rest of the forefoot as the foot rolls through the gait cycle from lateral arch area 136 toward toe area 138 of the shoe.

As the pressurized air moves towards toe area 138, some of the pressure in the lateral arch area 136 of the foot is released as exterior compartment 110 is allowed to expand. This expansion causes air to flow from interior compartment 112 back through fluid connector 116 towards lateral arch area 136 of exterior compartment 110.

As the heel rises, all of the external force is removed from heel portion 108 of sole 102. As this happens, air pressure is equalized within heel portion 108 of sole 102. Similarly, as the toe comes off forefoot portion 106 at "toe-off," the air pressure is equalized within forefoot portion 106 of sole 102. During the next step in the gait cycle, the process is repeated.

Because forefoot portion 106 and heel portion 108 are separate components, their construction can be different, as would be apparent to one of ordinary skill in the art. In the embodiment of FIG. 1, however, the construction of portions 106 and 108 is the same. Only the dimensions and general shape of portions 106 and 108 are different, in order to conform to the contours of a typical shoe. Therefore, equivalent parts, as described in FIGS. 2A-2E, will be referred to as the same components for both forefoot portion 106 and heel portion 108.

Figure 2A:
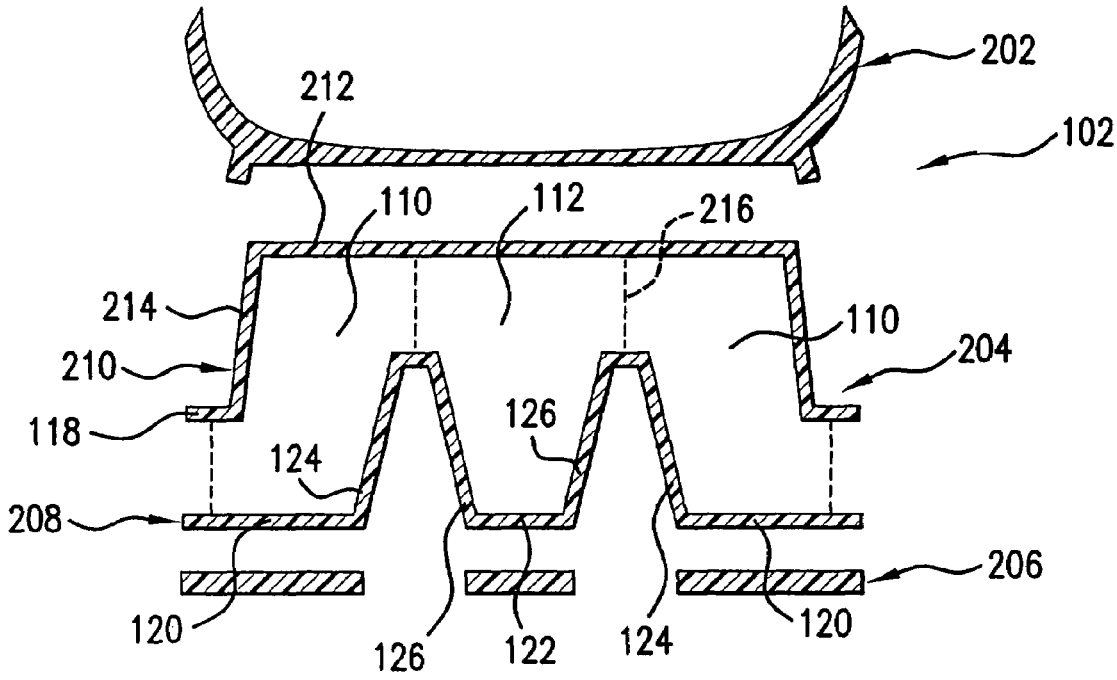
FIG. 2A is an enlarged cross-sectional, exploded assembly view taken along line A-A of FIG. 1.

Referring now to FIG. 2A, an exploded view of the construction of sole 102, taken along line A-A of FIG. 1, sole 102 comprises a foot plate 202, a hollow sole 204 in each of forefoot portion 106 and heel portion 108 as described above, and an outsole 206. As seen in FIG. 1, hollow sole 204 preferably does not extend the entire length of sole 102, but is divided into forefoot portion 106 and heel portion 108. Alternative arrangements are possible, however, as would be apparent to one of ordinary skill in the art. Hollow sole 204 could extend under arch area 132 either connected to or disconnected from one or both of forefoot portion 106 and heel portion 108 in alternative embodiments. Foot plate 202 is preferably made from a hard thermoplastic material which is injection molded into the desired shape. In the alternative, foot plate 202 can be thermoformed, compression molded, or vacuum formed in a conventional manner. Foot plate 202 allows for connection of sole 102 to a conventional shoe upper.

Hollow sole 204 is preferably made from a thermoplastic or elastomeric material which has characteristics such that it is more flexible than footplate 202. Hollow sole 204 comprises bottom component 208 and top component 210 which can be formed separately by conventional injection molding procedures and sealed together by RF (radio frequency) welding, heat welding, ultrasonic welding, or cementing. Alternatively, bottom component 208 and top component 210 of hollow sole 204 can be formed as a unitary structure having the desired shape discussed below via conventional blow molding techniques.

Top component 210 comprises a flat portion 212 and outer walls 214 which form the outside walls of hollow sole 204. Top component 210 is joined with bottom component 208 around a flat circumference 118 of top component 210. Flat circumference 118 can be any distance from the edge of the bottom component. In the alternative, outer wall 214 may be formed in conjunction with bottom component 208. In this case, top component 210 is joined with bottom component 208 around a flat circumference 118 of top component 210.

Figure 2B:
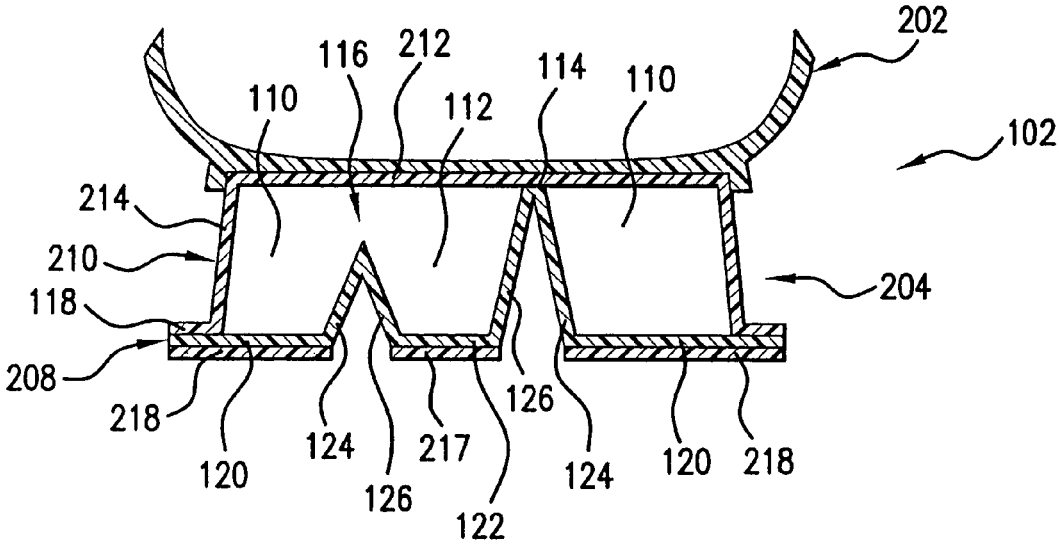
FIG. 2B is a cross-sectional view along line B-B of FIG. 1.

Referring now to FIG. 2A, discontinuous weld line 114 as described with respect to FIG. 1 is formed such that part of bottom component 208 is sealed to flat portion 212 of top component 210. Reference lines 216 indicate where bottom component 208 is sealed to top component 210 by RF welding, heat welding, or ultrasonic welding when sole 102 is fully assembled (as shown in FIG. 2B).

Bottom component 208 has a first flat portion 120 disposed beneath exterior compartment 110 and a second flat portion 122 disposed beneath interior compartment 112. First flat portion 120 extends from outside wall 214 to rising wall 124. Rising wall 124 extends from first flat portion 120 up to discontinuous weld line 114. Similarly, falling wall 126 extends from discontinuous weld line 114 to second flat portion 122. Bottom component 208 and top component 210 can be of any thickness provided that hollow sole 204 remains resilient. In one embodiment, top component 210 is made of stiffer (i.e., higher durometer) thermoplastic material than bottom component 208 such that outer wall 214 is more sturdy and less collapsible than rising wall 124 and falling wall 126.

Having outerwall 214 more sturdy and rising wall 124 and falling wall 126 more resilient provides cushioning as rising wall 124 and falling wall 126 flex, while outer wall 214 maintains structural support.

As seen in FIG. 1, second flat portion 122 is generally oval in shape and is encompassed by first flat portion 120 which has a ring shape. FIG. 1 also shows that rising wall 124 and falling wall 126 are generally ring shaped. As seen in FIG. 2A, rising wall 124 and falling wall 126 not only create the division between interior compartment 112 and exterior compartment 110 but also form exterior walls of hollow sole 204 and may form part of the exterior of sole 102.

Referring now to FIG. 2B, a cross-sectional view of sole 102 taken along line B-B of FIG. 1, fluid connector 116 is formed where rising wall 124 and falling wall 126 do not extend to top component 210. In the area of fluid connection 116, rising wall 124 and falling wall 126 are shorter than those in the area of discontinuous weld line 114, leaving a gap between bottom component 208 and top component 210 for the fluid to flow between exterior compartment 110 and interior compartment 112.

Figure 2C:
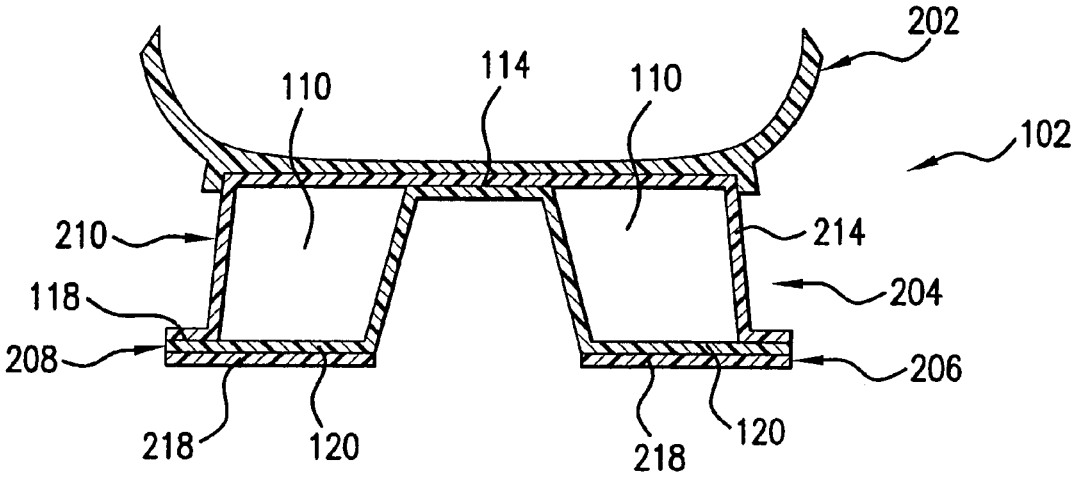
FIG. 2C is a cross-sectional view taken along line C-C of FIG. 1.

Referring now to FIG. 2C, a cross-sectional view of sole 102 taken along line C-C of FIG. 1, discontinuous weld line 114 joins bottom component 208 to top component 210 at only one location, such that interior compartment 112 is not present in this location.

Figure 2D:
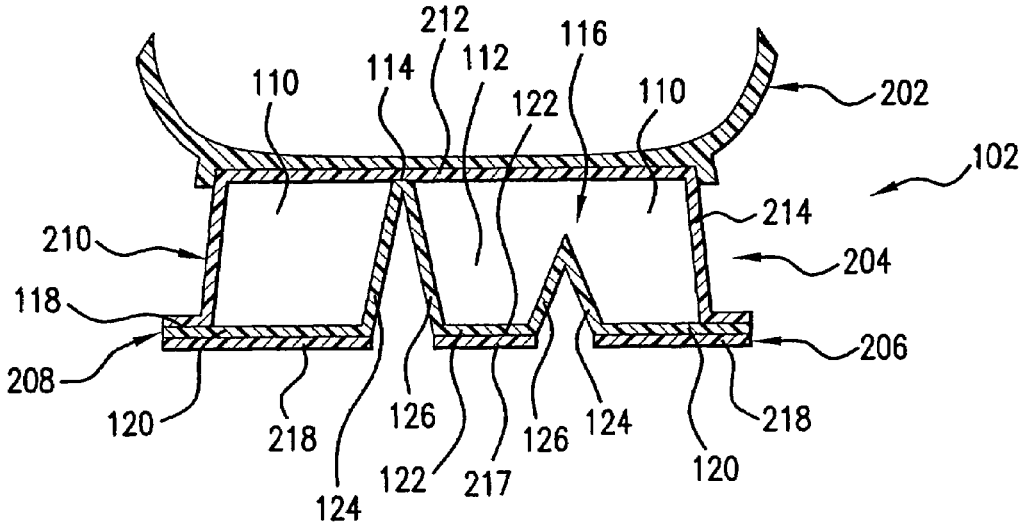
FIG. 2D is a cross-sectional view taken along line D-D of FIG. 1.

Referring now to FIG. 2D, a cross-sectional view of sole 102 taken along line D-D of FIG. 1, as discussed above, forefoot component 106 and heel component 108 are similarly constructed, except with respect to the size and shape of each component. Accordingly, forefoot component 106 also comprises a footplate 202, a hollow sole 204, and an outsole 206. Top component 210 is joined with bottom component 208 around a flat circumference 118 of bottom component 208. Discontinuous weld line 114 is formed such that part of bottom component 208 is sealed to flat portion 212 of top component 210. Fluid connecter 116 is formed where rising wall 124 and falling wall 126 do not extend to flat portion 212 of top component 210.

As shown in FIGS. 2A-2E, sole 204 is sandwiched between foot plate 202 and outsole 206. Foot plate 202 is adhered to flat portion 212 of top component 210 of hollow sole 204. FIG. 3A shows a bottom view of one embodiment of heel portion 108. The shaded area is outsole 206. Outsole 206 has an inner outsole 217 which is adhered to second flat portion 122 of bottom component 208 and an outer outsole 218 which is adhered to first flat portion 120 of bottom. component 208. Inner outsole 217 is adjacent to interior compartment 112 and conforms with the circular shape of second flat portion 122, as seen in FIG. 1. Similarly, outer outsole 218 is adjacent to exterior compartment 110 and conforms to the ring shape of first flat portion 120.

Figure 2E:
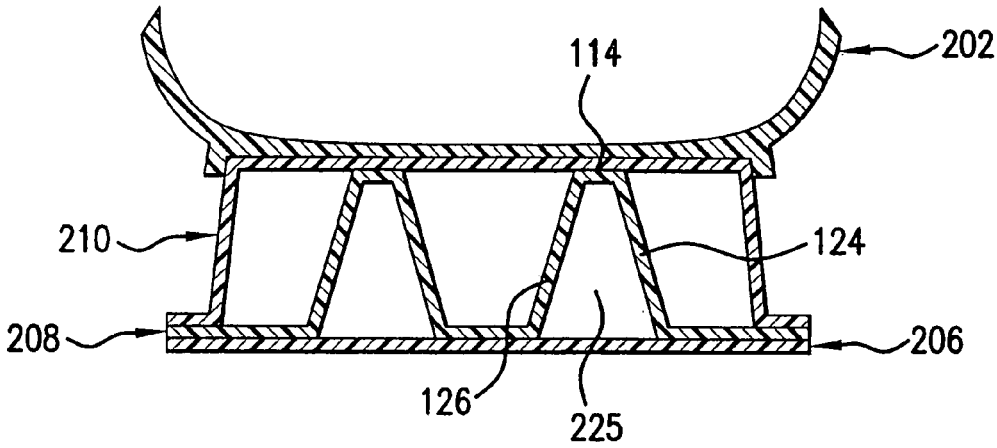
FIG. 2E is an enlarged cross-sectional view of an alternate embodiment of the hollow container of the present invention taken along line A-A of FIG. 1.
Figure 3A:
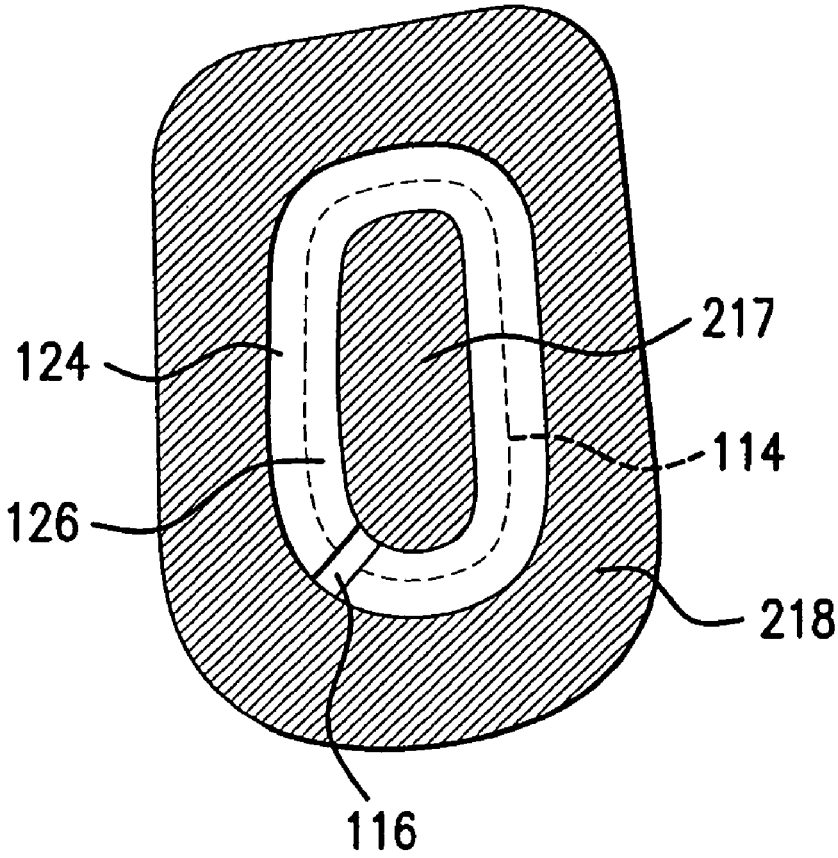
FIG. 3A is a bottom plan view of a heel section of the present invention.
Figure 3B:
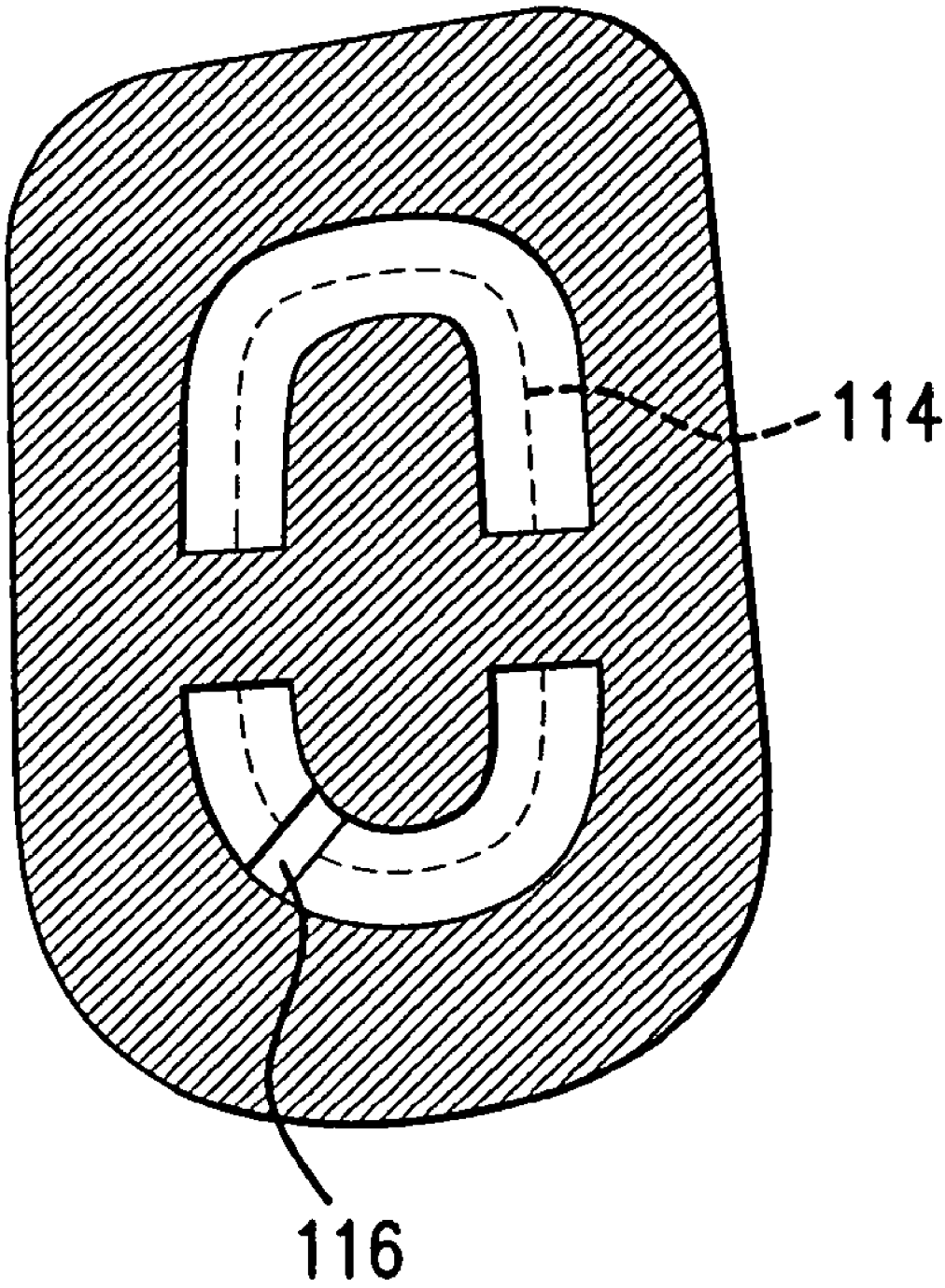
FIG. 3B is a bottom plan view of a heel section of an alternate embodiment of the present invention.
Figure 3C:
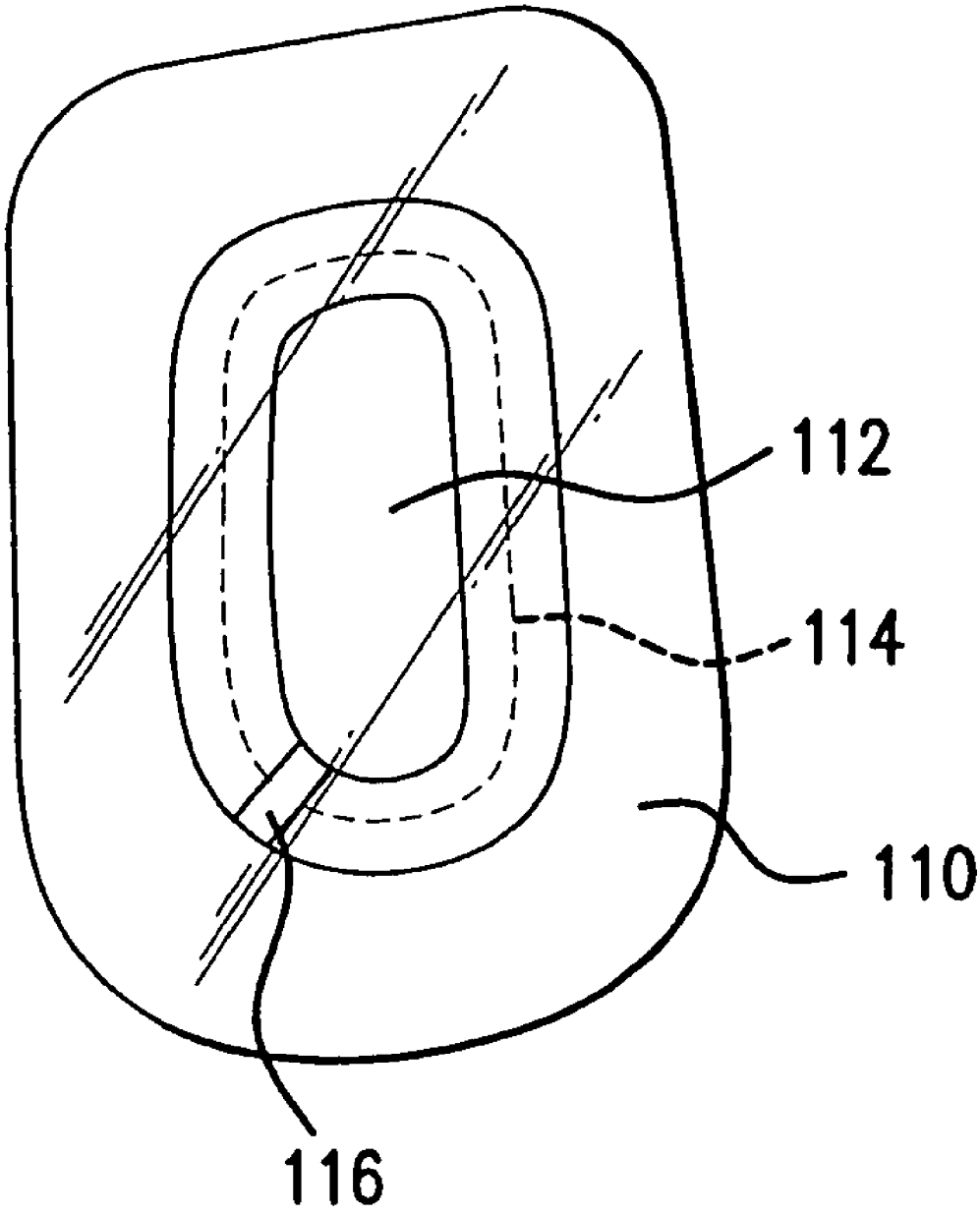
FIG. 3C is a bottom plan view of a heel section of a second alternate embodiment of the present invention.

An alternate configuration for outsole 206 is described in reference to FIG. 2E, a cross-sectional view of an alternate embodiment of sole 102 taken along line A-A of FIG. 1, as described above. This configuration is also shown in FIG. 3C, a bottom plan view of heel portion 108. In this embodiment, outsole 206 is a single, solid piece of material, adhered to the entire bottom surface of bottom component 208. As shown in FIG. 2E, this creates pockets 225 formed from rising wall 124, falling wall 126, and outsole 206. This closing of the open space formed by rising wall 124 and falling wall 126 provides additional stability to the shoe. In this embodiment, hollow sole 204 is not visible from a bottom, exterior view of the shoe, but only, potentially, from a side view.

Outsole 206 is generally a thin layer made of a wear resistant material, such as high density foam, thermoplastic polyurethane, or rubber. In another embodiment, such as the embodiment shown in FIG. 3B, a bottom plan view of heel portion 108, outsole 206 may be somewhat thicker and have a top surface with indentations generally conforming to the shape of first flat portion 120 and second flat portion 122, which receives and is adhered to first flat portion 120 and second flat portion 122. In this case, hollow sole 204 may be only partially visible from the exterior of the shoe.

The lack of a conventional PU or EVA foam midsole material in the preferred construction of this embodiment of the present invention keeps the sole relatively low to the ground for increased stability. However, in an alternative embodiment of the present invention, sole 102 may include a midsole, comprising EVA foam midsole material, disposed between footplate 202 and hollow sole 204, as an alternative to foot plate 202, or completely surrounding hollow sole 204 as would be apparent to one of ordinary skill in the art.

Figure 4A:
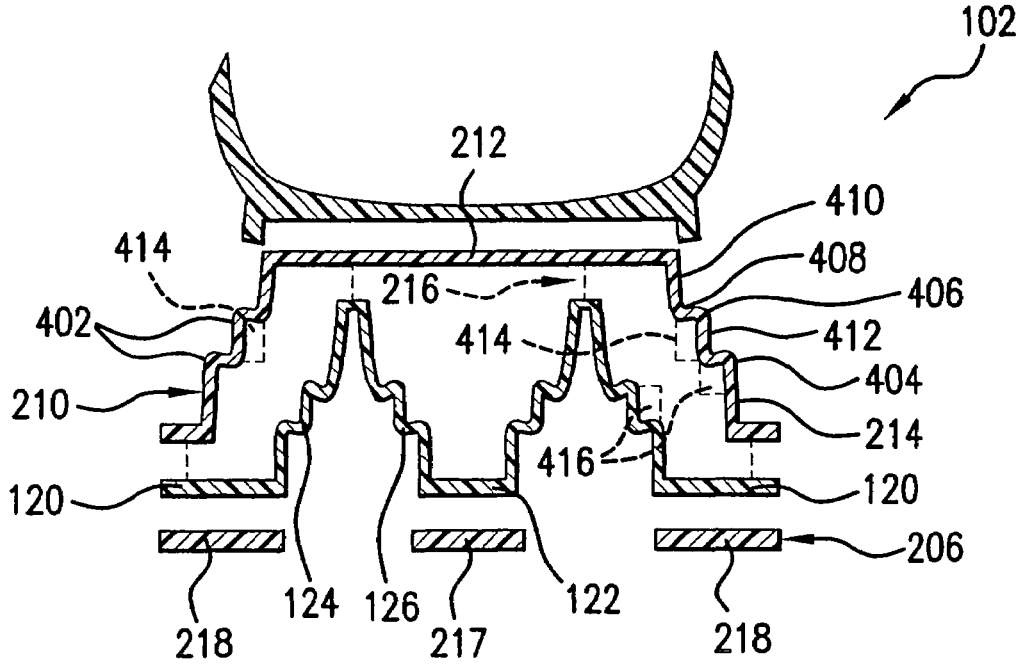
FIG. 4A is an enlarged cross-sectional exploded assembly view of a third alternate embodiment of the hollow container of the present invention taken along line A-A of FIG. 1.
Figure 4B:
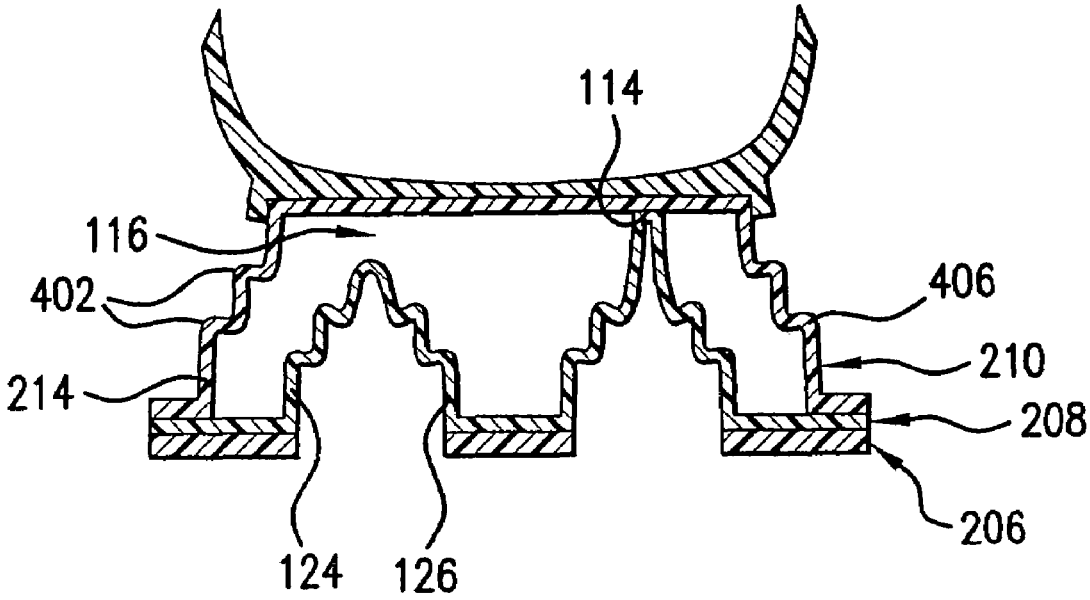
FIG. 4B is an enlarged cross-sectional view of the embodiment shown in FIG. 4A taken along line B-B of FIG. 1.

In a preferred embodiment, at least one of outer wall 214, rising wall 124 and falling wall 126 are not straight. Instead, theses walls have flexible ridges (as shown in FIGS. 4A and 4B) such that the walls are capable of compressing when pressure is applied. FIG. 4A shows the walls of this preferred embodiment in an exploded cross section along line A-A of FIG. 1. FIG. 4A shows the ridges of outer wall 214, rising wall 124 and falling wall 126 of the present invention.

As discussed above, the walls are resilient despite the flexible ridges 406. However, the flexible ridges provided a bellows-type effect when the weight of the foot applies downward pressure to specific areas of top component 210. As the foot provides pressure, not only will top component 210, in a particular area, compress slightly, but outer wall 214, rising wall 124 and falling wall 126 in that same area will also compress. Compression of top component 210 and the walls reduces the volume in that area and increases air pressure causing air to flow to other areas of hollow sole 204 where the pressure is lower.

The walls are flexible but resilient and are not collapsed in their natural state. As the foot begins to release pressure, the energy stored in the compressed walls will release causing the walls to return to their natural state. The released energy will create an upward force which is transferred to the foot providing a slight spring to each step.

Referring now to FIG. 4A, in one embodiment of the present invention the walls have two ridges. The ridges can be flat surfaces as is shown on the left hand side of FIG. 4A in ridges 402. Preferably, however, the ridges are shaped as shown on the right side of FIG. 4A in ridges 404, having a peak 406 and a trough 408. As pressure is added, upper section 410 above ridge 404 and midsection 412 below the ridge 404 move toward each other, thereby flattening ridge 404 in between. The overall volume of hollow sole 204 is reduced by a volume 414 contained just inside each peak 406 on outside wall 214. Similarly, volumes 416 can be displaced as section above and below ridge 404 or rising and falling walls 124, 126 move closer to each other. However, a complete collapse i.e., flat portion 212 of top component 210 contacting first flat portion 120 or second flat portion 122 may not have sufficient support and may actually drain energy from the wearer.

Variations of this bellowing effect are also contemplated by the present invention. For example, there can be any number of ridges along outer wall 214, rising wall 124 and falling wall 126. In addition, peaks 406 and troughs 408 can be of any height or width. However, the wider and the deeper peaks and troughs are, the more volume is consumed upon compression.

The bellows-shaped walls also eliminate the need for any other shock absorbing material to be added. Consequently, the overall height of the sole can be dramatically reduced. The foot then rests low to the ground, lowering the center of gravity and increasing the stability of the wearer when he or she takes a step.

Other shapes for a bellows type wall are also contemplated by the present invention, as would be apparent to one of ordinary skill in the art. For example, the walls may have an accordion shape wherein a cross section of the walls would generally appear to be a sideways W shape with more or less than two Vs. In this configuration, the lines of the W move closer to each other when pressure is applied. Again, however, energy may be drained if walls are not resilient enough such that the lines of the W shape completely collapse.

FIG. 4B shows how fluid connection 116 is formed by rising wall 124 and falling wall 126 comprising flexible ridges 402 on the left and flexible ridges 406 on the right. Additionally, fluid connection 116 is generally small in width, preferably in the form of a small tunnel-shaped passage between interior compartment 112 and exterior compartment 110, as bottom component 208 preferably includes such a tunnel-shaped structure at the point or points of discontinuity of weld line 114. Thus, even though top component 210 will somewhat collapse, it is preferred that outer wall 214, rising wall 124 and falling wall 126 at the ends of discontinuous weld line 114 on either side of fluid connection 116 are resilient enough to keep top component 210 from cutting off fluid connection 116. Similarly, forefoot portion 106 may have such bellows-shaped walls (not shown) having the same general shape as shown in FIGS. 2C and 2D but with the bellows-shaped walls as identified in FIGS. 4A and 4B.

Figure 6:
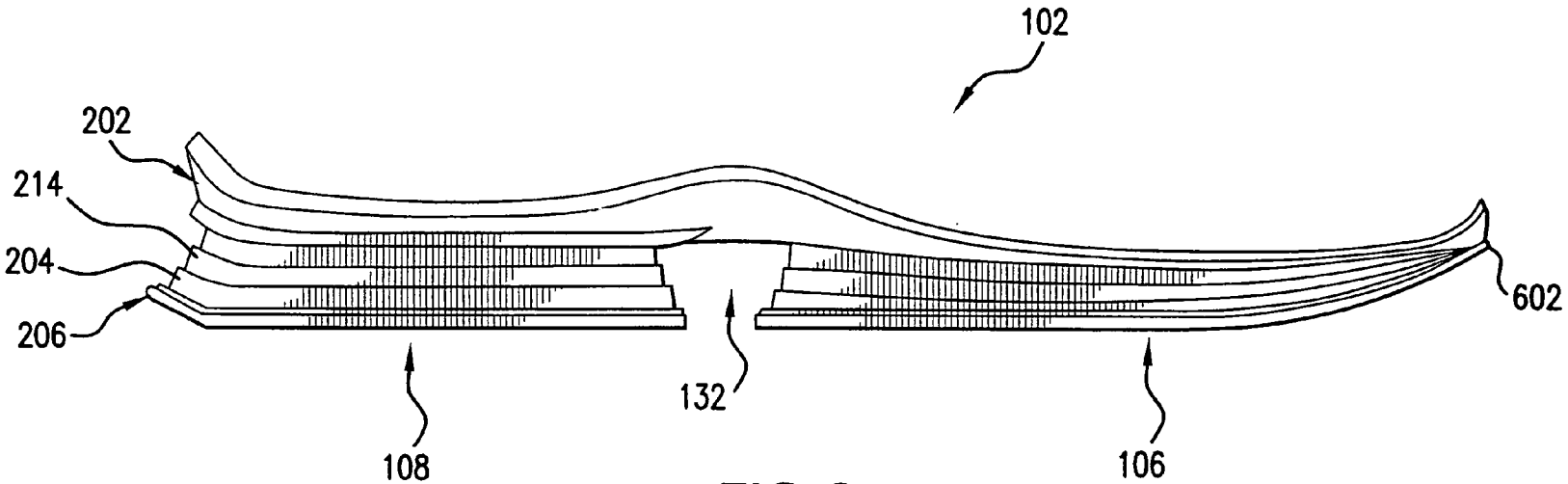
FIG. 6 is a medial side view of the sole of FIG. 1.

FIG. 6 is a medial side view of sole 102 of FIG. 1 showing the separation between heel portion 108 and forefoot portion 106 at arch area 132. In the embodiment of FIG. 6, forefoot portion 106 is formed such that ridges 404 all converge at toe point 602, even prior to compression. Consequently, at toe point 602, there is no outer wall 214. Thus, rising wall 124 and falling wall 126 will be somewhat shorter and bottom component 208 and top component 210 will be closer together approaching toe point 602 versus arch area 132 of forefoot portion 106. This construction also allows the foot to be closer to the ground, increasing stability and reducing the likelihood of tripping over a higher toe point 602. As would be apparent to one of ordinary skill in the art, sole 102 may be constructed without either of heel portion 108 or forefoot portion 106 without departing from the scope of the invention. In such an arrangement, a conventional forefoot portion could be used with the heel portion 108 of the present invention or a conventional heel portion could be used with forefoot portion 106 of the present invention.

Because the initial heel strike causes the most downward force of the entire gait cycle, additional cushioning is preferred where the heel strikes. As shown in FIG. 6, heel portion 108 is preferably thicker than forefoot portion 106, with outer wall 214, rising wall 124 and falling wall 126 somewhat longer, particular at rear lateral area 130 of heel portion 108.

Figure 5:
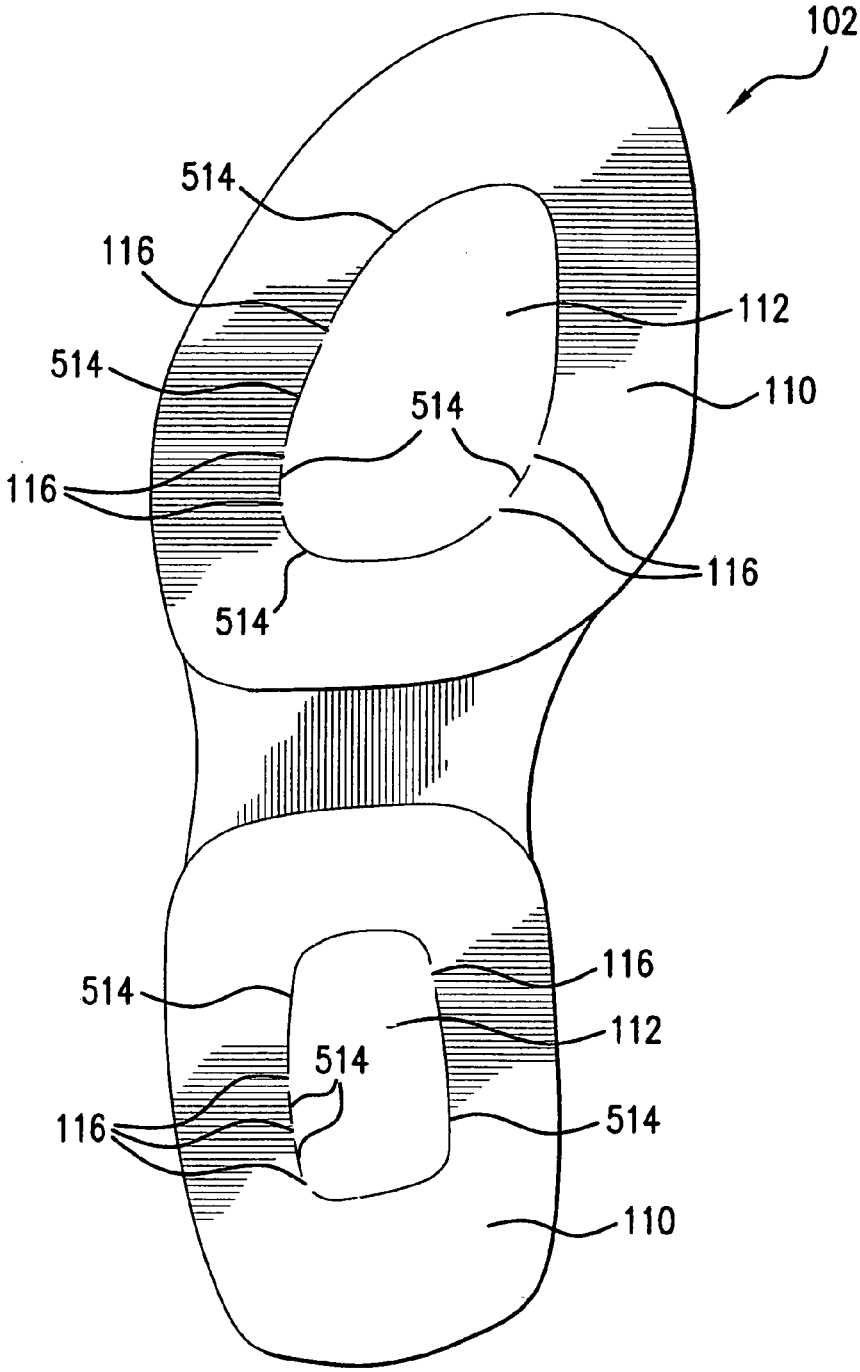
FIG. 5 is a bottom plan view of an alternate embodiment of the sole of the present invention.

As discussed above, hollow sole 204 is preferably filled with air at ambient pressure. However, it is contemplated that the hollow sole 204 may also be filled with pressurized air or be inflatable to a variety of pressures. Air at ambient pressures has the benefit of not having air diffuse out of hollow sole 204 over time and not requiring an inflation mechanism and/or release valve to adjust the pressure within the system. Further it can be appreciated that fluid mediums other than air can provide adequate support and movement in hollow sole 204 of the present invention, such as liquids and large molecule gases. Nonetheless, it is contemplated that these features could be added without changing the scope of the present invention. For example, it is not necessary that hollow sole 204, especially discontinuous weld lines, outer wall 214, fluid connection 116, exterior compartment 110 and interior compartment 112 be shaped as shown in the figures. For example, FIG. 5 shows that a discontinuous weld line 514 need not be C-shaped as in FIG. 1 or even generally oval shaped. Instead, it may be generally rectangular, pentagonal, hexagonal or any other shape that defines an interior compartment 112 and exterior compartment 110. Additionally, as is shown in FIG. 5, discontinuous weld line 514 defining the interior compartment 112 and exterior compartment 110 may be intermittently discontinuous, so as to provide more than one fluid connection 116, depending upon how the designer wishes to direct the flow of fluid between interior compartment 112 and exterior compartment 110. Changing the shape of weld lines can change the shape of fluid connections 116, exterior compartments 110, and interior compartments 112 in a manner that allows each to still perform the same function.

Figure 7:
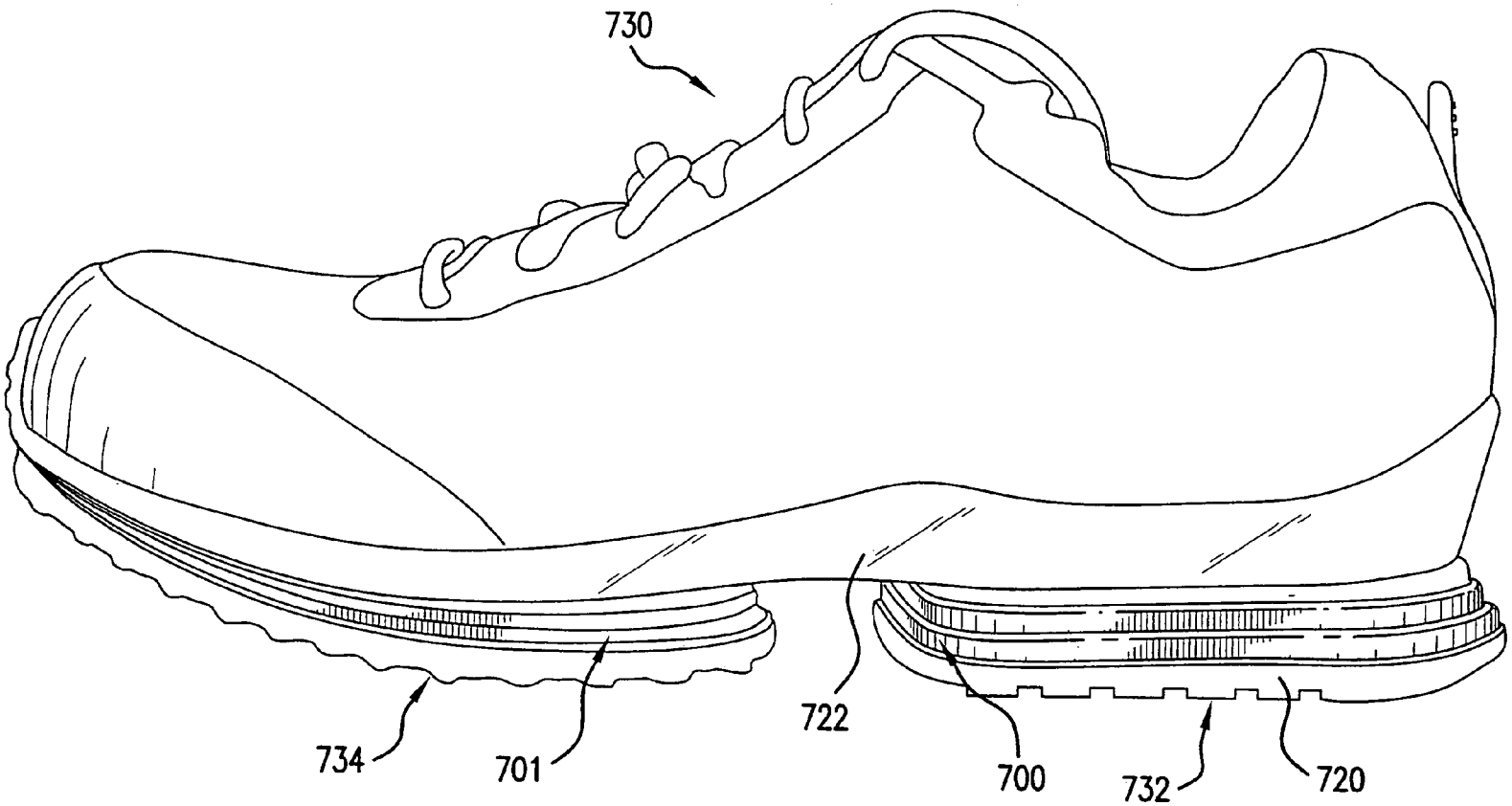
FIG. 7 is a side view of a shoe with cushioning soles of the present invention in the heel and metatarsal regions.

In an alternate embodiment of the present invention the open spaces within the hollow container of the cushioning sole of the present invention may contain a core. The core is made of a stiff material, such as high density foam, in order to provide increased stability to the shoe. Compartments that provide the cushioning air flow are defined by the core material as opposed to the weld lines of the embodiments described above with respect to FIGS. 1-6. Referring now to FIG. 7, a cushioning heel portion 700 is located in a heel region 732 of a shoe 730. A cushioning forefoot portion 701 is located in a forefoot region 734 of shoe 730. As with the embodiment described above, cushioning soles 700, 701 have similar construction; only the dimensions of soles 700, 701 differ, in order to conform to the typical shape of shoe 730 in the different regions. Heel portion 700 will be described in detail below, however, it will be apparent to one of ordinary skill in the art that forefoot portion 701 may be constructed in a similar manner.

Heel portion 700 is sandwiched between an outsole 720 and a footplate 722. As with outsole 206 as described above with respect to the embodiment shown in FIG. 2, outsole 720 may be made of any wear-resistant material that provides appropriate traction, such as compression molded rubber. Plate 722 is made of stiffer material, such as injection molded TPU. As with footplate 202, described above with respect to the embodiment shown in FIG. 2, plate 722 is preferably made from a hard thermoplastic material which is injection molded into the desired shape. Alternatively, plate 722 can be thermoformed, compression molded, or vacuum formed in a conventional manner. Plate 722 allows for connection of sole 102 to a conventional shoe upper. In cases where a lighter shoe is desired, plate 722 may be eliminated altogether.

Figure 7A:
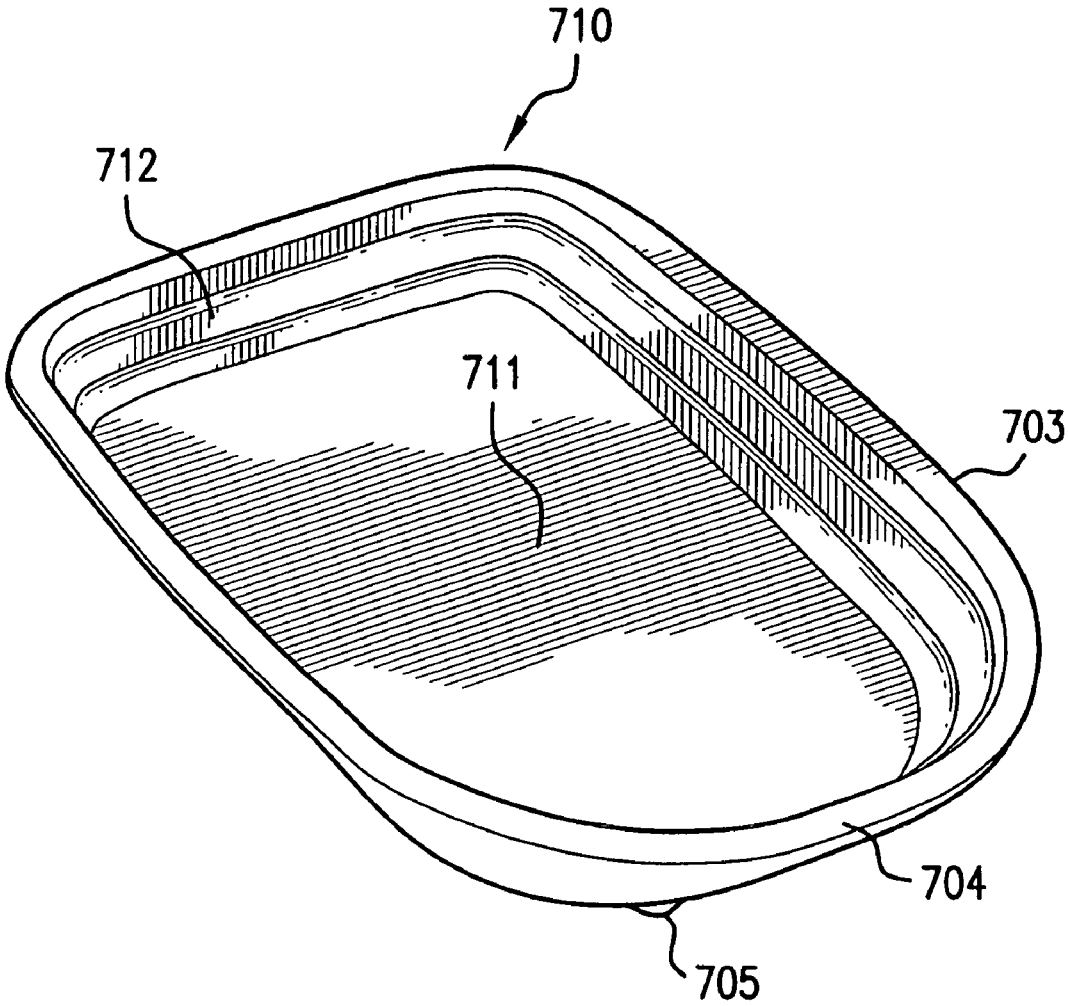
FIG. 7A is a perspective view of the hollow container of the present invention with a second surface thereof removed.
Figure 7B:
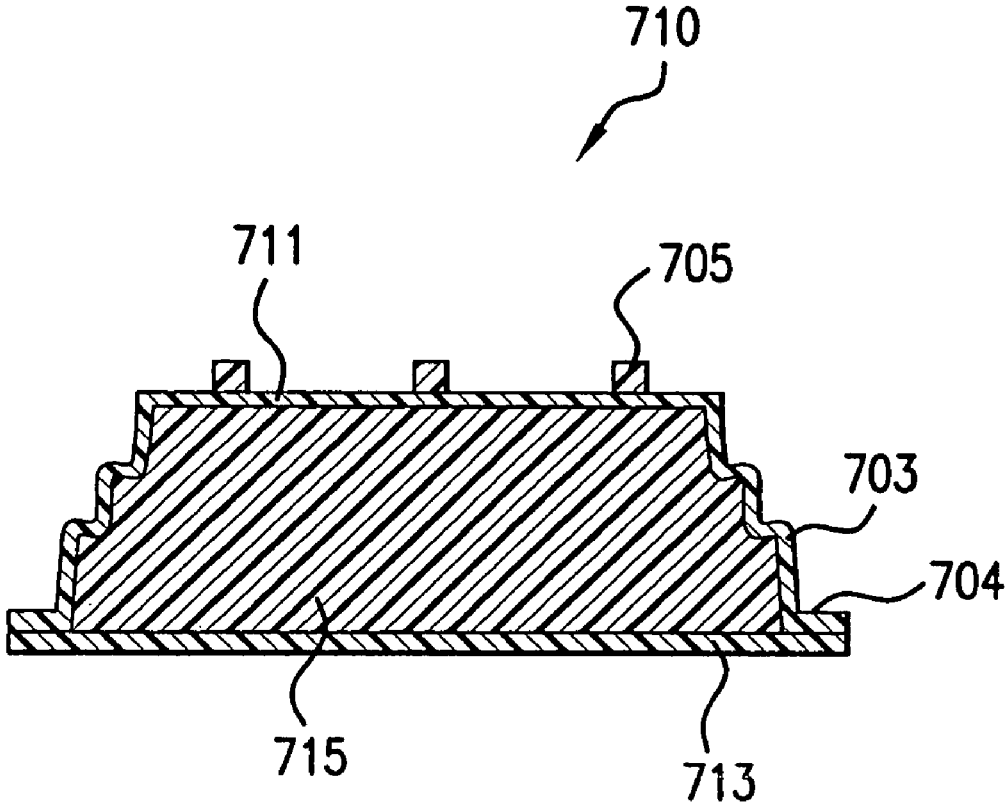
FIG. 7B is a cross-sectional view of the sole of the present invention.

Referring now to FIG. 7A, cushioning sole 700 includes a hollow container 710. Hollow container 710 is preferably made from injection molded TPU, although other materials with similar properties may also be used. The walls of hollow container 710 are approximately 1.0 mm thick, although the actual thickness of the walls will vary greatly depending upon the type of material used and the desired flexibility and durability of cushioning sole 700. As shown in FIGS. 7A and 7B, hollow container 710 includes a first generally flat surface 711, three protrusions 705 or the like disposed on the exterior of first surface 711 which are used as locating guides during the manufacturing process (such protrusions can be eliminated as would be apparent to one of ordinary skill in the art), four sidewalls 703, a flat flange 704 on the surface of sidewalls 703, and a second generally flat surface 713 (shown in FIG. 7B) disposed opposite to first surface 711. Second surface 713 is injection molded or die-cut separately from the rest of hollow container 710. Unlike the hollow container described above with respect to the embodiment shown in FIG. 2, hollow container 710 simply defines an enclosed space without further defining the compartments therein. After a core 715 has been inserted into hollow container 710, second surface 713 is high frequency welded to hollow container 710 at flat flange 704. Other welding or adhesion methods may also be used, such as heat welding, ultrasonic welding, or cementing. Completed hollow container 710 is generally fluid-impermeable, although some of the interior fluid may diffuse through the material.

Sidewalls 703 of hollow container 710 may also include ridges 712, shown in FIG. 7B, to produce a bellows-like effect that function similarly to those described above, in order to provide additional spring-like action to the step. Further, all of the variations of the bellow-shaped walls as described above apply equally to sidewalls 703. For example, there can be any number of ridges along sidewall 703. In addition, ridges 712 can be of any height or width. In addition to adding "springiness" to the step, the bellows-like action of sidewalls 703 helps to compress core 715 and encourages the flow of the fluid contained within the fluid system of core 715.

Referring now to FIGS. 8-13, various embodiments of core 715 are shown placed in container 710 with second surface 713 removed for purposes of clarity. Core 715 is preferably constructed of foam, such as PU, EVA, or other similar materials. If the foam is too soft, then core 715 will not provide sufficient support to container 710. As such, a soft foam core may lead to instability in the footwear, overflexing of container 710 during each step cycle, and early failure of container 710. If the foam is too hard, the wearer may suffer discomfort or even injury due to the inflexibility of container 710. For example, in the embodiment shown in FIG. 14, having a single density foam core 1415 and a fluid system including compartments 1406 and fluid conduits 1408, the preferred durometer range of the foam for use in athletic footwear for cushioning purposes is 45-60 on the Asker C scale, with a more preferred range being 48-57 on the same scale. This range may change depending upon the actual design elements, including the arrangement of the fluid system within the core, the type of fluid system, and the type of foam.

Figure 11:
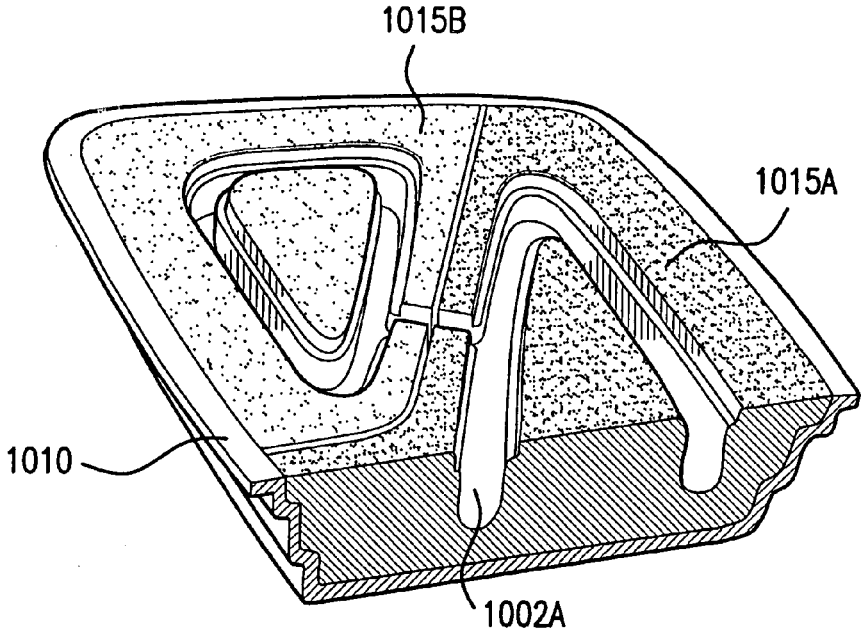
FIG. 11 is a perspective, cross-sectional view of the invention in FIG. 10 taken along line A-A.
Figure 13:
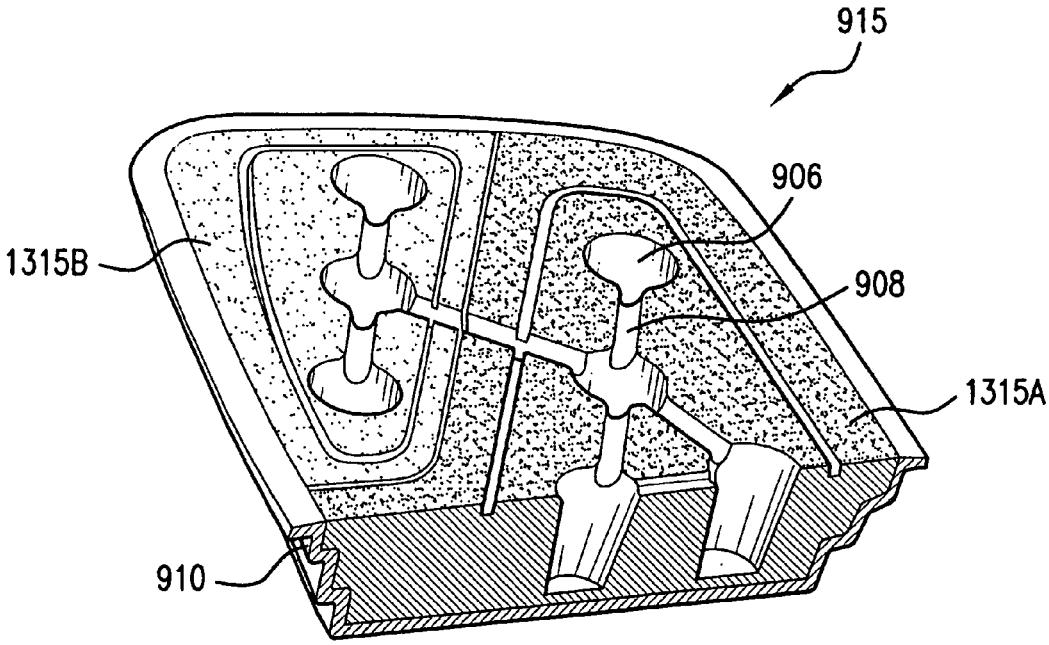
FIG. 13 is a perspective, cross-sectional view of the present invention with the second surface removed, having a dual-foam core with multiple fluid chambers disposed in each piece of foam.
Figure 14:
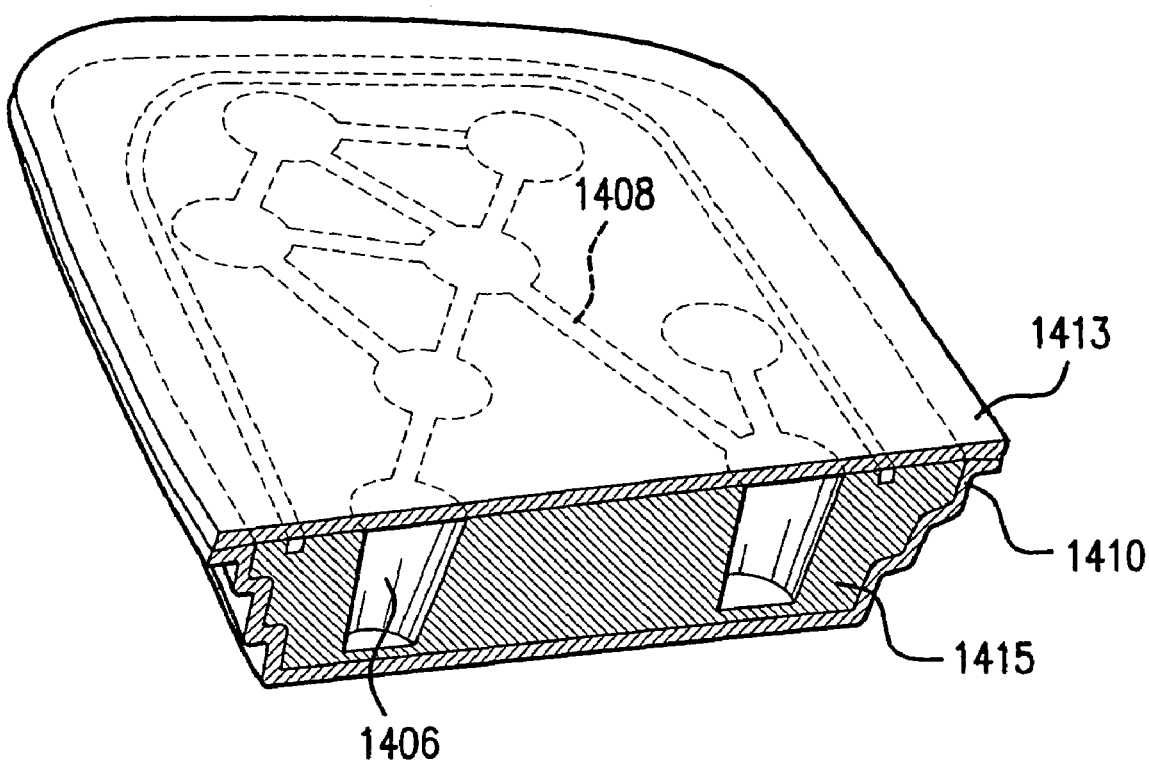
FIG. 14 is a perspective, cross-sectional view of the present invention having a single-foam core with multiple fluid chambers.

Core 715 may be molded to the appropriate shape with the compartments formed therein, or else the foam may be cut or carved. As seen in FIGS. 11 and 13, the compartments in core 715 preferably do not extend entirely therethrough, although such a hole in core 715 is contemplated by the present invention. Core 715 is placed inside container 710, and, preferably cemented therein to sufaces 711 and 713 of container 710. This cementing helps to contain the fluid within the compartments and also maintains the positioning of core 715 within container 710, which helps to reduce noise generation during a step cycle. It will be apparent to one of ordinary skill in the art that core 715 could also be fixed within container 710 with other methods, such as vacuum sealing container 710, mechanical fixation, or chemical adhesion, such as from inserting open-pour PU into a pre-sealed container.

Figure 8:
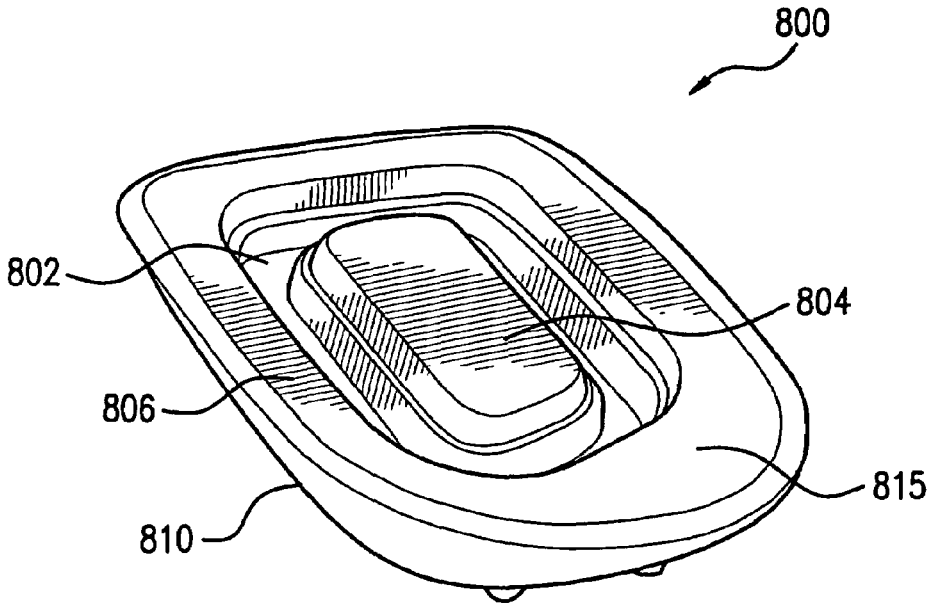
FIG. 8 is a perspective view of the present invention with a second surface removed, showing a single fluid chamber in a single piece of foam.

FIG. 8 shows a core 815 made from a single piece of foam contained within a hollow container 810. A single compartment 802 is defined by core 815. Fluid, such as air, nitrogen, other gases, or liquid, is contained within compartment 802. For the purposes of description herein, the fluid is assumed to be air at ambient pressure, although this description in no way limits the fluid of the present invention to air at ambient pressure. As the wearer steps down, the step is initially cushioned by the foam and the air in that portion of compartment 802. As more external pressure is applied, hollow container 710 in the region of the external pressure compresses, raising the pressure of the air in that portion of compartment 802. This causes the air to flow to areas of lesser pressure within compartment 802, thereby cushioning the foot as the foot rolls through the typical gait cycle. When the external pressure is removed, the foam of core 815 expands and air within compartment 802 equalizes in preparation for the next step.

In an alternative embodiment, a center pillar 804 formed within core 815 may be hollow. A small hole (not shown) may be disposed in pillar 804, thereby fluidly connecting the interior of pillar 804 with compartment 802. This embodiment would then function as the foamless embodiments described above with respect to FIGS. 1-6, with air or other fluid being transferred between the interior of pillar 804 and compartment 802 through the small hole, as described above with respect to fluid connector 116 above, as external pressure is applied to cushioning sole 800.

In yet another alternative embodiment, core 815 may be made of foams of different densities. In one embodiment, pillar 804 is made of a softer material for enhanced cushioning, while an exterior rim 806 is made of a harder material for increased lateral stability. For example, pillar 804 may have a durometer of 51 on the Asker C scale, while exterior rim 806 may have a durometer of 61 on the same scale.

Figure 9:
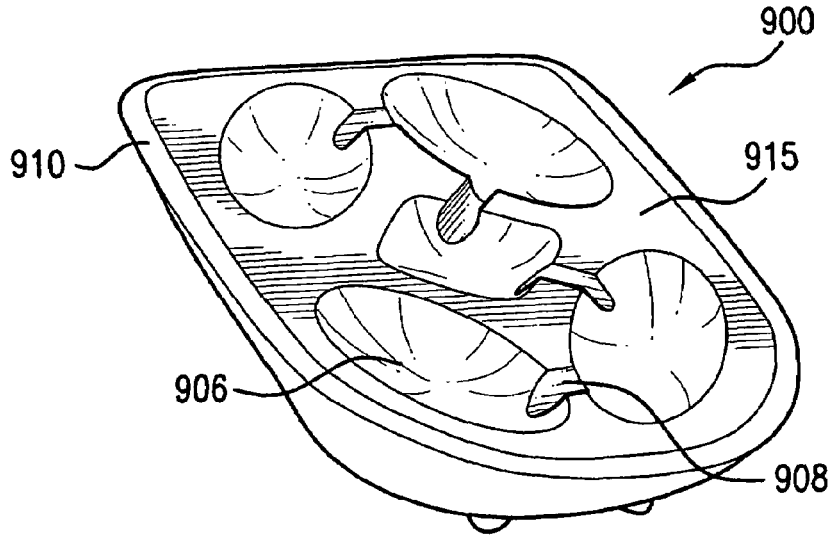
FIG. 9 is a perspective view of the present invention with the second surface removed, showing multiple fluid chambers in a single piece of foam.

FIG. 9 shows another arrangement of a fluid system for a cushioning sole 900, with the fluid system located within a core 915 disposed in a hollow container 910. As discussed above, the material of core 915 is preferably foam, although other materials are also appropriate. Multiple compartments 906, significantly smaller in volume than compartment 802, are contained within core 915. Compartments 906 are fluidly connected via fluid conduits 908. Fluid, such as air, nitrogen, other gases, or liquid, is contained within the fluid system. As with the embodiment described above with respect to FIG. 8, for the purposes of description herein, the fluid is assumed to be air at ambient pressure, although this description in no way limits the fluid of the present invention to air at ambient pressure. As the wearer steps down, the step is initially cushioned by the foam and air in the fluid system in the rear lateral region of core 915. As more external pressure is applied, the foam in the rear lateral region compresses, causing the pressure of the air in that part of the fluid system to increase. The air then flows through the system of conduits 908 and compartments 906 to areas of lower pressure, thereby providing extra cushioning as the foot rolls through the typical gait cycle. As above, when the external pressure is removed, the air within the system equalizes in preparation for the next step.

Core 915 within hollow container 910 provides for varying degrees of cushioning, depending upon the amount of force exerted upon hollow container 910 during the step. For example, sole 900 reacts with a soft cushioning effect in response to the slow, steady application of force typically encountered during a standard walking step. The air within the fluid system is gently moved from one part the fluid system to another, so core 915 provides the main cushioning effect. In contrast, sole 900 reacts with a firmer cushioning effect in response to the sudden, intense application of force typically encountered during a standard running step. The air within the fluid system is forced to move much more quickly, so the resistance to this movement translates to a firmer feel as the air prevents core 915 from flexing as much as during a walking step.

Figure 10:
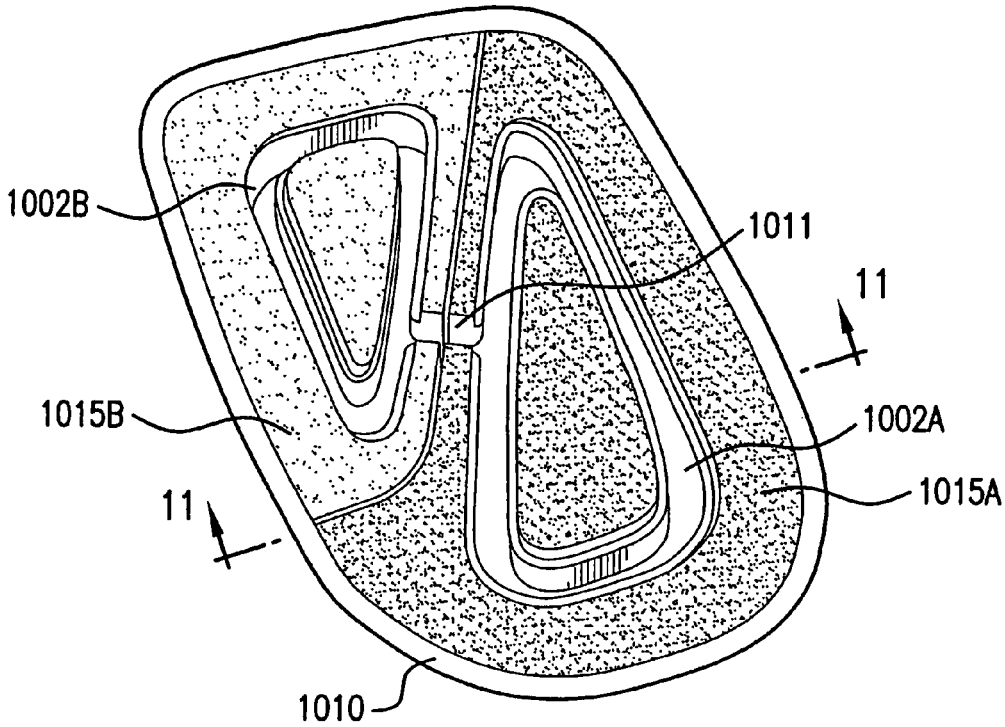
FIG. 10 is a perspective view of the present invention, with the second surface removed, having a dual-foam core with a single fluid chamber disposed in each piece of foam.
Figure 12:
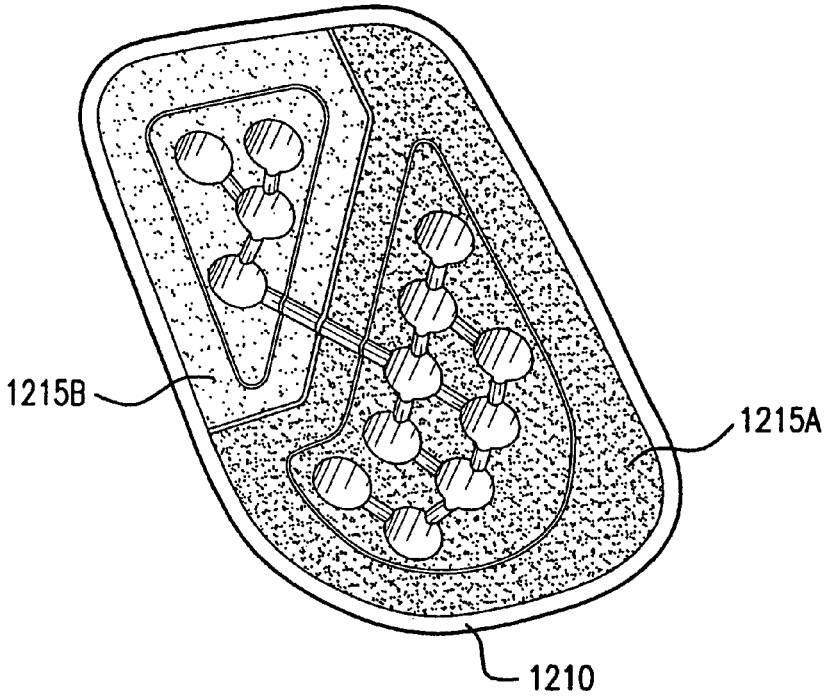
FIG. 12 is a perspective view of the present invention with the second surface removed, having a dual-foam core with multiple fluid chambers disposed in each piece of foam.

FIGS. 10 and 12 show similar structures; however, with the core being made from two pieces of material having different densities 1015A, 1015B and 1215A, 1215B. Again, the preferred material of the core is foam. The fluid system functions as described above. Referring to FIG. 10, heelstrike foam 1015A is slightly softer than medial foam 1015B. For example, heelstrike foam 1015A may be PU or EVA with a rating of 51±3 on the Asker C scale, while medial foam may be PU or EVA with a rating of 57±3 on the Asker C scale. The embodiment shown in FIG. 10 has a fluid system similar to that of the embodiment shown in FIG. 8. Core 1015A, disposed within a hollow container 1010, defines a first compartment 1002A similar in shape to that of compartment 802 and foam 1015B defines a second such compartment 1002B. These compartments are fluidly connected by a fluid conduit 1011. The foams in FIG. 12 may have similar characteristics, although the fluid system disposed therein is similar to that described above with respect to the embodiment shown in FIG. 9. This variation in the densities of the two foams provide additional posting to prevent the foot from over-pronation.

Also, the number and shape of fluid pockets 906 and fluid compartments 802 are not limited to those disclosed herein. Fluid pockets 906 may be elliptical, circular, rectangular, or irregularly shaped. Fluid compartment 802 may carve a trough as shown, or the shape may be elliptical, circular, or irregular. Further, in an embodiment such as that shown in FIG. 8, center core 804 may be eliminated altogether.

It will also be readily appreciated that sole 102 or 700 may comprise cushioning sole 204,700 in only forefoot portion 106,734 or in only heel portion 108, 732.

The present invention also includes an article of footwear including hollow sole 204, 710 of the present invention. Further, it is presumed that the preferred embodiment of hollow sole 204, 710 of the present invention will find its greatest utility in athletic shoes (i.e., those designed for running, walking, hiking, and other athletic activities.)

The foregoing description of the embodiments are presented for purposes of illustration and description. The description not intended to be exhaustive or to limit the invention to the precise form disclosed, and obviously many modifications and variations are possible in light of the above teachings. While this invention has been particularly shown and described with reference to preferred embodiments thereof, it will be understood by those skilled in the art that various changes in form and details may be made therein without departing from the spirit and scope of the invention.

What is claimed is:

1. A shoe sole comprising:

a hollow container made of a gas-impermeable material and having a top component and a bottom component, said hollow container defining an enclosed space;

a fluid system disposed within said hollow container, said fluid system comprising an interior compartment which is fluidly connected to and encompassed about its entire perimeter by an exterior compartment; and a fluid disposed within said fluid system, whereby pressure applied to said hollow container causes said fluid to flow between said interior and exterior compartments, wherein said top component of said hollow container and said bottom component of said hollow container are welded together along a weld line that defines said interior compartment and said exterior compartment.

2. The shoe sole according to claim 1, wherein said weld line is discontinuous.

3. The shoe sole according to claim 1, wherein said bottom component comprises a first flat portion forming a wall of said exterior compartment and a second flat portion forming a wall of said interior compartment, a rising wall portion from said first flat portion to said weld line, and a falling wall portion from said weld line to said second flat portion.

4. The shoe sole according to claim 3, wherein said rising wall and said falling wall are comprised of flexible ridges.

5. The shoe sole according to claim 4, wherein said flexible ridges are stepped ridges.

6. The shoe sole according to claim 1, wherein said hollow container is disposed in at least one of a forefoot portion and a heel portion of said sole.

7. The shoe sole of claim 1, wherein said shoe sole further comprises an outsole defining a ground engaging surface, wherein said outsole is coupled to said bottom component of said hollow container.

8. A shoe sole comprising:

a hollow container made of a gas-impermeable material and having a top component and a bottom component, said hollow container defining an enclosed space;

a fluid system disposed within said hollow container, said fluid system comprising an interior compartment which is fluidly connected to and encompassed about its entire perimeter by an exterior compartment; and a fluid disposed within said fluid system, whereby pressure applied to said hollow container causes said fluid to flow between said interior and exterior compartments; wherein said top component of said hollow container and said bottom component of said hollow container are welded together along a weld line that defines said interior compartment and said exterior compartment, and wherein said top component comprises a flat portion having a perimeter and a sidewall extending from around said perimeter, wherein said sidewall is composed of flexible ridges.

9. The shoe sole according to claim 8, wherein said weld line is discontinuous.

10. The shoe sole according to claim 8, wherein said flexible ridges are stepped ridges.

11. The shoe sole according to claim 10, wherein said stepped ridges increasingly protrude from said flat portion of said top component.

12. The shoe sole according to claim 8, wherein said hollow container is disposed in at least one of a forefoot portion and a heel portion of said sole.

13. The shoe sole of claim 8, wherein said shoe sole further comprises an outsole defining a ground engaging surface, wherein said outsole is coupled to said bottom component of said hollow container.

14. An article of footwear comprising:

an upper; and a sole, said sole including a hollow container made of a gas-impermeable material and having a top component and a bottom component, said hollow container defining an enclosed space; a fluid system disposed within said hollow container, said fluid system comprising an interior compartment which is fluidly connected to and encompassed about its entire perimeter by an exterior compartment; and a fluid disposed within said fluid system, whereby pressure applied to said hollow container causes said fluid to flow between said interior and exterior compartments, wherein said top component of said hollow container and said bottom component of said hollow container are welded together along a weld line that defines said interior compartment and said exterior compartment.

15. The shoe sole according to claim 14, wherein said weld line is discontinuous.

16. The shoe sole according to claim 14, wherein said bottom component comprises a first flat portion forming a wall of said exterior compartment and a second flat portion forming a wall of said interior compartment, a rising wall portion from said first flat portion to said weld line, and a falling wall portion from said weld line to said second flat portion.

17. The shoe sole according to claim 16, wherein said rising wall and said falling wall are comprised of flexible ridges.

18. The shoe sole according to claim 17, wherein said flexible ridges are stepped ridges.

19. The shoe sole according to claim 14, wherein said container is disposed in at least one of a forefoot portion and a heel portion of said sole.

20. The shoe sole of claim 14, wherein said shoe sole further comprises an outsole defining a ground engaging surface, wherein said outsole is coupled to said bottom component of said container.

* * * * *